US006761127B2

(12) United States Patent
Field et al.

(10) Patent No.: US 6,761,127 B2
(45) Date of Patent: Jul. 13, 2004

(54) APPARATUS FOR CURING FLOOR COATINGS USING ULTRAVIOLET RADIATION

(75) Inventors: Bruce F. Field, Golden Valley, MN (US); Earl O. F. Krueger, Jr., Eagan, MN (US)

(73) Assignee: Tennant Company, Minneapolis, MN (US)

( * ) Notice: Subject to any disclaimer, the term of this patent is extended or adjusted under 35 U.S.C. 154(b) by 239 days.

(21) Appl. No.: 10/086,790

(22) Filed: Feb. 28, 2002

(65) Prior Publication Data

US 2003/0159308 A1 Aug. 28, 2003

(51) Int. Cl.[7] ..... B05C 9/08

(52) U.S. Cl. ..... 118/620; 118/641; 118/642; 118/643

(58) Field of Search ..... 118/620, 641, 118/642, 643; 250/504 R, 504; 427/508, 553

(56) References Cited

U.S. PATENT DOCUMENTS

| | | | | | |
|---|---|---|---|---|---|
| 3,787,303 | A | * | 1/1974 | Guthrie et al. | 427/517 |
| 3,855,093 | A | * | 12/1974 | Guthrie et al. | 427/520 |
| 3,898,349 | A | * | 8/1975 | Kehr et al. | 427/500 |
| 3,930,064 | A | * | 12/1975 | Sander | 427/492 |
| 3,935,364 | A | * | 1/1976 | Proksch et al. | 428/292.4 |
| 3,975,554 | A | * | 8/1976 | Kummins et al. | 427/8 |
| 4,122,225 | A | * | 10/1978 | Holmstrom et al. | 428/172 |
| 4,163,082 | A | * | 7/1979 | Romenesko | 428/447 |
| 4,287,228 | A | * | 9/1981 | Schlesinger | 427/514 |
| 4,289,798 | A | * | 9/1981 | Bagley et al. | 427/493 |
| 4,308,118 | A | * | 12/1981 | Dudgeon | 428/63 |
| 4,339,566 | A | * | 7/1982 | Rosenkranz et al. | 427/66 |
| 4,374,955 | A | * | 2/1983 | Gupta et al. | 525/281 |
| 4,411,931 | A | * | 10/1983 | Duong | 427/492 |
| 4,421,784 | A | * | 12/1983 | Troue | 427/492 |
| 4,478,876 | A | * | 10/1984 | Chung | 427/515 |
| 4,479,726 | A | * | 10/1984 | Townsend | 374/1 |
| 4,568,558 | A | * | 2/1986 | Angrick et al. | 427/229 |
| 4,597,987 | A | * | 7/1986 | Hockemeyer et al. | 427/513 |
| 4,656,053 | A | * | 4/1987 | Angrick et al. | 427/519 |
| 4,768,311 | A | | 9/1988 | Olson | 51/174 |
| 4,920,254 | A | * | 4/1990 | DeCamp et al. | 219/547 |
| 4,999,216 | A | * | 3/1991 | Gaske et al. | 427/519 |
| 5,141,990 | A | * | 8/1992 | McKoy et al. | 522/4 |
| 5,425,970 | A | * | 6/1995 | Lahrmann et al. | 427/493 |
| 5,534,310 | A | | 7/1996 | Rokowski et al. | 427/494 |
| 5,536,758 | A | | 7/1996 | Boldt | 522/4 |
| 5,667,227 | A | | 9/1997 | Boldt | 277/652 |
| 5,712,022 | A | | 1/1998 | Tanaka et al. | 428/195.1 |
| 5,716,551 | A | | 2/1998 | Unruh et al. | 252/500 |
| 6,096,383 | A | | 8/2000 | Berg et al. | 427/493 |
| 6,197,844 | B1 | | 3/2001 | Hamrock et al. | 522/167 |
| 6,468,350 | B1 | * | 10/2002 | Hillenbrand | 118/620 |
| 6,538,258 | B1 | * | 3/2003 | Rau et al. | 250/504 R |

OTHER PUBLICATIONS

"*Multi–Clean—Ultra Violet*, Single Floor Coat System for Tile, Wood & Concrete" datasheet [online]. Minuteman International, Inc., Addison, IL, [retrieved on May 1, 2002]. Retrieved from the Internet: http://www.multi–clean.com/multiclean/ultra.html (5 pgs.).

(List continued on next page.)

*Primary Examiner*—Laura Edwards
(74) *Attorney, Agent, or Firm*—Mueting, Raasch & Gebhardt, P.A.

(57) ABSTRACT

Machines and methods for curing ultraviolet (UV) curable floor coatings are provided. In one embodiment, the machine includes a UV radiation source having one or more lamps where each lamp is operable to simultaneously emit UV radiation at two or more wavelengths and at relatively low power consumption, e.g., no more than about 75 watts per inch of cured coating width. The floor coating includes components that are reactive to these two or more wavelengths such that substantial or complete curing of the floor coating may occur upon simultaneous exposure to the two or more wavelengths. Preferably, the UV radiation emitted by each of the one or more lamps is greater at the two or more wavelengths than at wavelengths other than the two or more wavelengths.

35 Claims, 4 Drawing Sheets

OTHER PUBLICATIONS

Morgan et al., "Thiol/ene photocurable polymers," *J. Polym. Sci., Polym. Chem. Ed.*, 1977 15(3):627–645.

Eco–DQF™—Decorative Quartz Flooring Instruction Bulletin. Tennant Company, Minneapolis, MN (Jun. 14, 1999).

Eco–DQF™—Decorative Quartz Flooring Tech Data Bulletin. Tennant Company, Minneapolis, MN (Jun. 7, 1999).

Eco–DQF™—Decorative Quartz Flooring Architectural Guide Specification. Tennant Company, Minneapolis, MN (Jul. 1, 1999).

Gush et al., "Thiol/acrylate Hybrid Systems in Radiation–curable Coatigs—The Best of Both Worlds," The Chemical Coatings Conference II, Cincinnati, OH, May 10, 1978; pp. 37–53.

Gush et al., "Thiol/acrylate Hybrid Systems *May Offer the Best of Both Worlds in Radiation–curable Coatings," Modern Paint and Coatings*. Nov. 1978; pp. 58, 61, 62, 64, and 66.

Morgan, "Radiation–curable Polymers for Closures," *Radiation Curing*. Aug. 1974;1(3):11–14.

Morgan et al., "Photosensitized Thiol/ene Reactions," The American Chemical Society Division of Organic Coatings and Plastic Chemistry 165th Meeting, Apr. 8–13, 1973;33(1):281–288.

Pappas, ed., "*UV Curing: Science and Technology*," Technology Marketing Corporation, Stamford, CT (1978).

Roffey, "*Photopolymerization of Surface Coatings*," John Wiley & Sons (1982).

* cited by examiner

APPARATUS FOR CURING FLOOR COATINGS USING ULTRAVIOLET RADIATION

TECHNICAL FIELD

The present invention relates to systems for applying coatings to floor surfaces. More particularly, the present invention relates to methods and apparatus for curing floor surface coatings by application of ultraviolet (UV) radiation.

BACKGROUND OF THE INVENTION

Floor coatings are known in the art. These coatings are typically applied as a liquid which is subsequently cured to form a durable layer over the floor surface. Curing is generally achieved through thermal treatment and/or exposure to ambient conditions.

Floor coatings provide numerous advantages. For example, these coatings may be used to protect the underlying floor surface from damage associated with dirt, wear, exposure, or spillage. These coatings may also be used to provide a more aesthetically pleasing appearance and/or to improve overall ambient lighting (e.g., from increased floor reflection). Still further, by sealing the underlying floor surface, these coatings may simplify subsequent floor cleaning procedures.

However, even with these advantages, these coatings do have drawbacks. For instance, cure times for many conventional floor coatings can be substantial, e.g., anywhere from several hours to several days. As a result, floor traffic may be significantly interrupted during the curing process. While such interruptions may be acceptable in limited circumstances (e.g., new construction, remodeling), long cure times may make application of these coatings difficult, or, in some instances, impracticable.

To reduce these lengthy cure times, some floor coating materials are formulated to cure relatively instantly when subjected to ultraviolet (UV) radiation. These coatings typically include photo-responsive components that cure when exposed to particular wavelengths of UV radiation. In addition to reducing cure time, UV curable coatings may also reduce material costs (e.g., by eliminating solvents) and/or operational costs (e.g., no mixing and no conventional thermal curing equipment required).

While they may permit relatively instant curing, many conventional methods for UV curing of floor coatings use a single wavelength of UV radiation. These methods require UV curing apparatus having substantial power requirements. As a result, wide acceptance of these coatings and their associated curing apparatus has not been achieved.

To address these high power requirements, U.S. Pat. No. 6,096,383 to Berg et al. recites a flooring coating reactive to two different wavelengths of UV radiation and an apparatus for providing these multiple wavelengths sequentially to produce a cured floor coating.

SUMMARY OF THE INVENTION

The present invention is directed to methods and apparatus for curing a liquid floor coating material applied over a floor surface. In some embodiments, The invention utilizes an ultraviolet radiation source including one or more lamps where each of the one or more lamps is operable to simultaneously emit at least two different wavelengths of ultraviolet radiation.

In one particular embodiment, an apparatus for curing floor coatings is provided. The apparatus includes a frame supported by two or more ground engaging support members, and an ultraviolet radiation source coupled to the frame. The ultraviolet radiation source may include one or more lamps where each of the one or more lamps is operable to simultaneously emit at least two different wavelengths of ultraviolet radiation. The ultraviolet radiation source is further operable to consume power of no more than about 75 watts per inch of cured coating width.

In another embodiment, an apparatus for curing floor coatings is provided. The apparatus includes a frame supported by two or more ground engaging support members, and an ultraviolet radiation source coupled to the frame. The ultraviolet radiation source may include one or more lamps where each of the one or more lamps is operable to simultaneously emit at least two different wavelengths of ultraviolet radiation. A lowermost surface of the ultraviolet radiation source is suspended about 4 inches to about 7 inches above the floor coating.

In yet another embodiment, a machine operable for curing floor coatings applied to a floor surface is provided. The machine includes a frame supported by two or more ground engaging wheels and a curing head coupled to the frame. The curing head is located, when the machine is in an operating configuration, forward of an axis of rotation of the two or more ground engaging wheels. An ultraviolet radiation source associated with the curing head is also provided. The ultraviolet radiation source includes one or more lamps, wherein each of the one or more lamps is operable to simultaneously emit at least two different wavelengths of ultraviolet radiation. Furthermore, the ultraviolet radiation source is operable to consume power of no more than about 75 watts per inch of cured coating width.

In still yet another embodiment, a method for applying a floor coating to a floor surface is provided. The method includes applying a liquid coating over the floor surface, where the liquid coating is curable in response to application of at least two different wavelengths of ultraviolet radiation. The method also includes passing a source of ultraviolet radiation over the liquid coating applied over the floor surface. The source of ultraviolet radiation includes one or more lamps, wherein each lamp of the one or more lamps is operable to simultaneously emit the at least two different wavelengths of ultraviolet radiation. Furthermore, the ultraviolet radiation source is operable to consume power of no more than about 75 watts per inch of cured coating width. In addition, the method includes curing at least a portion of the liquid coating as the source of ultraviolet radiation passes over the liquid coating.

In yet another embodiment, an apparatus for curing a floor coating is provided. The apparatus includes a frame supported by two or more ground engaging support members and an ultraviolet radiation source coupled to the frame. The ultraviolet radiation source includes one or more lamps where each of the one or more lamps is operable to simultaneously emit at least two different wavelengths of ultraviolet radiation. The ultraviolet radiation emitted by each of the one or more lamps is greater at the at least two different wavelengths than at wavelengths other than the at least two different wavelengths.

The above summary of the invention is not intended to describe each embodiment or every implementation of the present invention. Rather, a more complete understanding of the invention will become apparent and appreciated by reference to the following detailed description and claims in view of the accompanying drawings.

BRIEF DESCRIPTION OF THE DRAWINGS

The present invention will be further described with reference to the drawings, wherein.

DETAILED DESCRIPTION OF EXEMPLARY EMBODIMENTS

Figure 1:
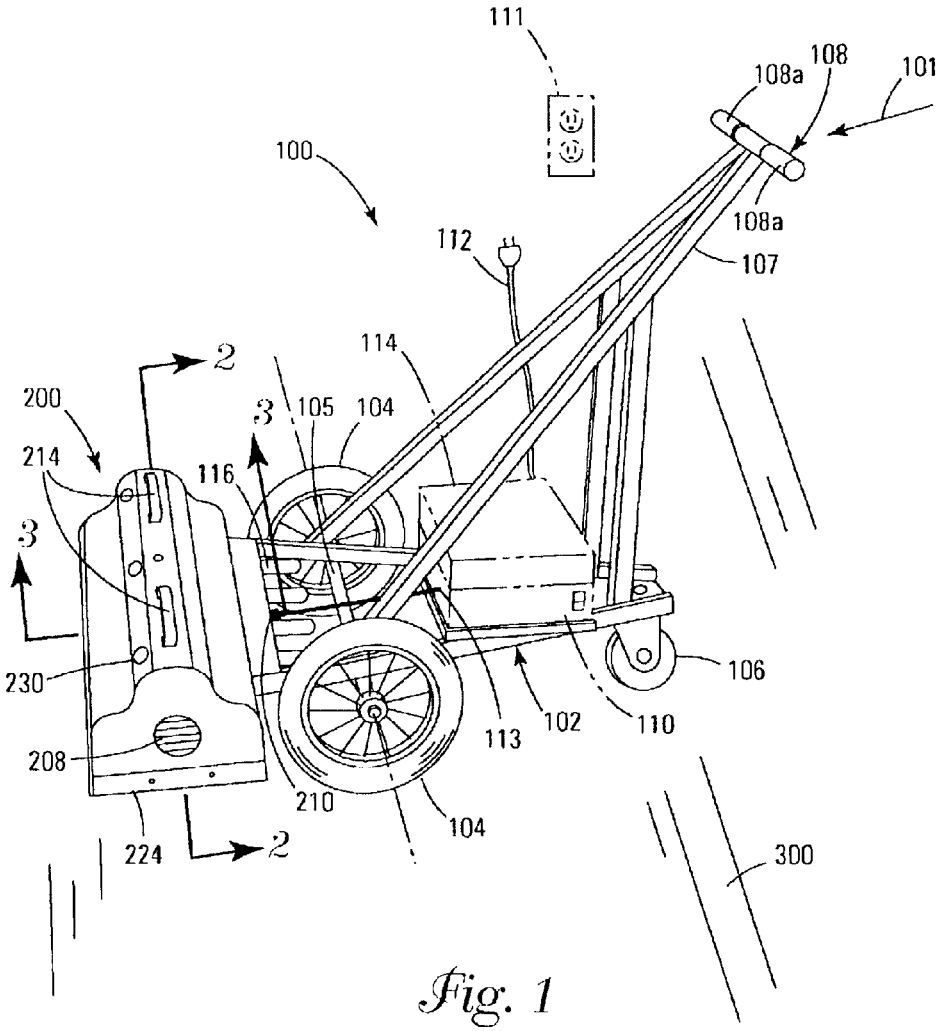
FIG. 1 is a perspective view of a UV curing apparatus in accordance with one embodiment of the invention.

In the following detailed description of the embodiments, reference is made to the accompanying drawings which form a part hereof, and in which are shown by way of illustration specific embodiments in which the invention may be practiced. It is to be understood that other embodiments may be utilized and structural changes may be made without departing from the scope of the invention.

Generally speaking, the present invention provides an apparatus and process for ultraviolet (UV) curing of a liquid floor coating applied over a floor surface. Floor surfaces may include, for example, but are not limited to, concrete, ceramic tile, wood, and vinyl. Floor coatings as described herein may be used to coat entire floor surfaces as well as to repair localized areas, e.g., to fill cracks.

The liquid coating may be applied to the floor in most any conventional manner, such as with a roller. After application, the coating is cured to a durable solid state by application of radiation from a mobile source of UV radiation as further described below. While the thickness of the applied liquid floor coating may vary depending on the particular application and on the condition of the floor surface, thicknesses from about 0.003 inches to about 0.006 inches are common. However, thicknesses up to and beyond 0.020 inches are contemplated.

To promote quick curing with reduced power requirements, coatings of the present invention include components that are preferably reactive to, i.e., cured by, UV radiation of at least two different wavelengths. For example, UV radiation at a first wavelength of about 350 nanometers (nm) to about 380 nm and, more preferably, at a wavelength of about 365 nm provides what is known as deep curing. Deep curing cures that portion of the coating closest to the floor surface and promotes adhesion with the floor. Simultaneous with the application of the first wavelength, UV radiation at a second wavelength of about 240 nm to about 270 nm and, more preferably, about 254 nm is applied. This second wavelength of UV radiation provides surface curing and assists in complete curing of the floor coating.

While described with respect to specific wavelengths of UV radiation, other wavelengths are certainly possible. In fact, coatings responsive to most any wavelengths are possible, provided that the UV reactive components within the floor coating are matched to the particular wavelengths of emitted UV radiation.

By providing dual wavelength UV radiation as described herein, the present apparatus and methods are capable of relatively instantly curing floor coatings with minimal power input. As a result, they may be powered from a 120-volt, 20-ampere wall outlet or, alternatively, from a small onboard generator set. Such low power curing is achieved by matching of the floor coating material with the UV radiation source, as further discussed below. Low power curing offers several advantages including, for example, reduced heat and, thus, less opportunity to overcure or "burn" the floor coating.

"Instant curing" is defined herein to include substantial curing of the coating material relatively instantly, e.g., within a few seconds or less. "Substantial curing" or "substantially cured" includes most any degree of curing or hardening of the coating material that results in at least a tack-free (e.g., not wet) coating surface. Unless stated otherwise herein, the terms "cured" and "curing" are used interchangeably with the terms "substantially cured" and "substantial curing."

With this introduction, exemplary floor coatings and methods and apparatus for UV curing the same will now be described.

Floor Coating Materials

The floor coatings (also referred to herein in their liquid form as "floor coating materials") of the present invention include, for example, urethane-based copolymers. In one embodiment, the floor coating material is produced by Norland Products, Inc. of New Brunswick, N.J. (U.S.A.), under the designation SW3. Another exemplary floor coating material is made by Summers Optical of Fort Washington, Pa. (U.S.A.), and sold under the designation VTC-2. Still yet another floor coating material is sold by the Tennant Company of Minneapolis, Minn. (U.S.A.) under the designation ECO-UVS. Other materials or substances, e.g., epoxy, polyester, and urethane acrylates, that polymerize under application of UV radiation are also possible without departing from the scope of the invention.

In addition to being UV reactive, the present floor coating materials may include conventional curing agents which permit curing by exposure to ambient light, e.g., air oxidation and/or exposure to visible light and/or atmospheric humidity. As a result, floor areas missed or not completely cured by the UV curing apparatus, e.g., corners or filled cracks in the floor that are too deep to cure initially, may still cure over time.

Various additives may optionally be included in the floor coating material. For example, in many applications, protection against static electricity is desirable. In these instances, indium tin oxide may be added to the coating. This additive is particularly beneficial as it provides the coating with electrically conductive properties which eliminate, or at least reduce, static electricity. Moreover, this additive does not interfere with the curing process and typically will not affect the coating color.

Other additives which may be included with the floor coating material include colorants (powder or liquid form) and texturing components. Texturing components may include, for example, high wear abrasive grits. These grits, in addition to adding texture to the floor coating, may also provide a no-slip surface and may further increase durability and usable wear life of the floor coating. While the actual texturing component(s) used may include most any grit (e.g., silicon carbide) or flake material, one preferred material is crystallized aluminum oxide. Crystallized aluminum oxide provides not only excellent durability/wear resistance, but also creates an observable difference in appearance between cured and uncured portions of the floor coating. This is beneficial to an operator controlling the curing apparatus (further described below) as he or she can clearly delineate that portion of the floor coating that has been cured from that portion that has not.

In a preferred embodiment, the floor coating material includes photoinitiators that cause the floor coating material to form a hard, durable floor coating once exposed to UV radiation in wavelengths of about 365 nm and about 254 nm. One benefit of curing the floor with UV radiation at a wavelength of 254 nm is that this specific wavelength may provide some degree of germicidal, (e.g., antibacterial or antimicrobial) protection to the UV cured area. However, these wavelengths are variable as long as the wavelengths of the respective UV reactive components of the floor coating material are matched to the emitted wavelengths of UV radiation from the curing apparatus.

While not particularly pertinent to the methods and apparatus of the present invention, the floor surface to be coated must often first be prepared to receive the UV curable coating. This preparation may vary depending on the floor type and condition. For example, in some situations, a previously applied floor coating must first be removed before a UV curable floor coating in accordance with the present invention may be applied. Removal may be accomplished in any number of ways. For instance, the coating may be softened with a solvent stripper and manually scraped off. More preferably, products such as those sold by Tennant Company under the name ECO-PREP may be used (for example, in conjunction with a sanding machine as described in U.S. Pat. No. 4,768,311) to remove the old coating and prepare the floor surface. Some floors may further require scrubbing, vacuuming, and/or acid-etching to ensure the floor surface is clean and capable of forming a strong adhesive bond with the new coating.

Ultraviolet Curing Apparatus

The apparatus for curing the floor coating is preferably a mobile device designed to travel over the floor surface being coated. The apparatus may be a walk-behind device (push or self-propelled) or a ride-on device. Ride-on devices and self-propelled walk-behind devices may be advantageous where the operator desires to maintain a relatively constant speed, e.g., where more particular and consistent control of UV exposure is desired.

For simplicity, the UV curing apparatus will hereinafter be described as a walk-behind, push-powered curing machine 100, an exemplary embodiment of which is illustrated in the attached Figures, see, e.g., FIG. 1. In this embodiment, an operator walks behind the machine 100 and provides a pushing force 101 to a handle 108 to control machine speed and direction. While the machine 100 is described herein as having particular overall dimensions, those of skill in the art will realize that it could be scaled and modified to accommodate applications requiring larger (or smaller) curing widths.

The embodiment of the machine 100 illustrated in FIG. 1 includes a frame 102 supported by ground engaging support members. The support members may, in one embodiment, include freely rotating forward or front wheels 104 (which rotate about an axis of rotation defined by an axle 105) and rear wheel 106. Preferably, the rear wheel 106 is a swiveling caster wheel that allows the machine 100 to be easily maneuvered during operation.

The frame 102 may be configured in various ways. For example, it may be formed from rectangular tubing (e.g., steel, aluminum) that is welded or otherwise interconnected to form the desired shape. The frame may alternatively, or additionally, include panel components, e.g., sheet metal, to provide additional structural support or to improve functionality and/or aesthetic appearance. In some embodiments, the frame may also be made of a lightweight material such as aluminum or plastic and may disassemble or fold to a compact size for storage/shipment.

As used herein, relative terms such as "left," "right," "fore," "front," "forward," "aft," "rear," "rearward," "top," "bottom," "upper," "lower," "horizontal," "vertical," and the like are from the perspective of one operating the machine 100 while the machine is in an operating configuration, e.g., while the machine is positioned such that the wheels 104 and 106 rest upon a generally horizontal floor surface as shown in FIG. 1. These terms are used herein to simplify the description, however, and not to limit the scope of the invention in any way.

The handle 108, illustrated at the rear of the machine 100 in FIG. 1, may include hand grip portions 108*a* for receiving the hands of the walking operator. Preferably, the hand grip portions 108*a* are positioned and configured to provide comfortable hand positioning during operation. In the illustrated embodiment of FIG. 1, the handle 108 and hand grip portions 108*a* are formed by an upwardly extending portion 107 of the frame 102.

The frame 102 may support various onboard equipment. For example, the frame may support a ballast apparatus 110 used to power a UV radiation source as further described below. In some embodiments, the ballast receives external power from a power cord 112 coupled to a remote power source, e.g., preferably a 120-volt wall receptacle 111. In other embodiments, the frame 102 may support a cordless, onboard power source 114 (schematically illustrated in FIG. 1) such as a gasoline-power generator set or a rechargeable battery pack which may be used to power the UV radiation source.

Forward of the front wheels 104 is a UV curing head 200. Preferably, the curing head 200 is cantilevered off the frame 102 such that it is supported above, but does not contact, the floor surface. The curing head 200 is also preferably configured to cure a floor width greater than the transverse wheel base (the lateral distance between the outer edges of the wheels 104) of the machine 100. That is, the UV curing head 200 preferably cures a path wider than the wheel base of the front wheels 104 so that the wheels 104 do not contact uncured floor surfaces. In the embodiment illustrated in FIG. 1, the curing head 200 provides a curing width of about 24 inches while the transverse wheel base of the machine 100 is about 18 inches.

Figure 2:
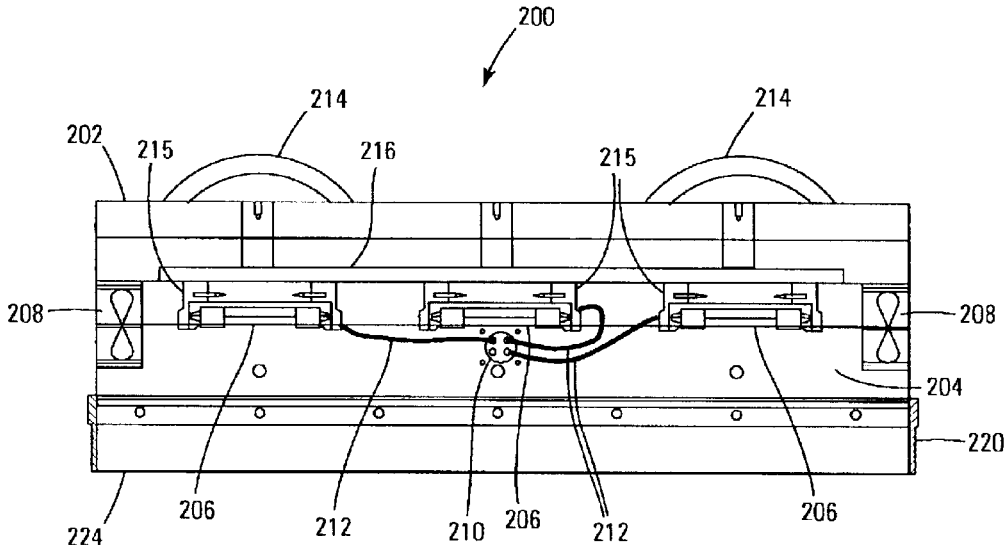
FIG. 2 is a partial section view taken along line 2—2 of FIG. 1.
Figure 3A:
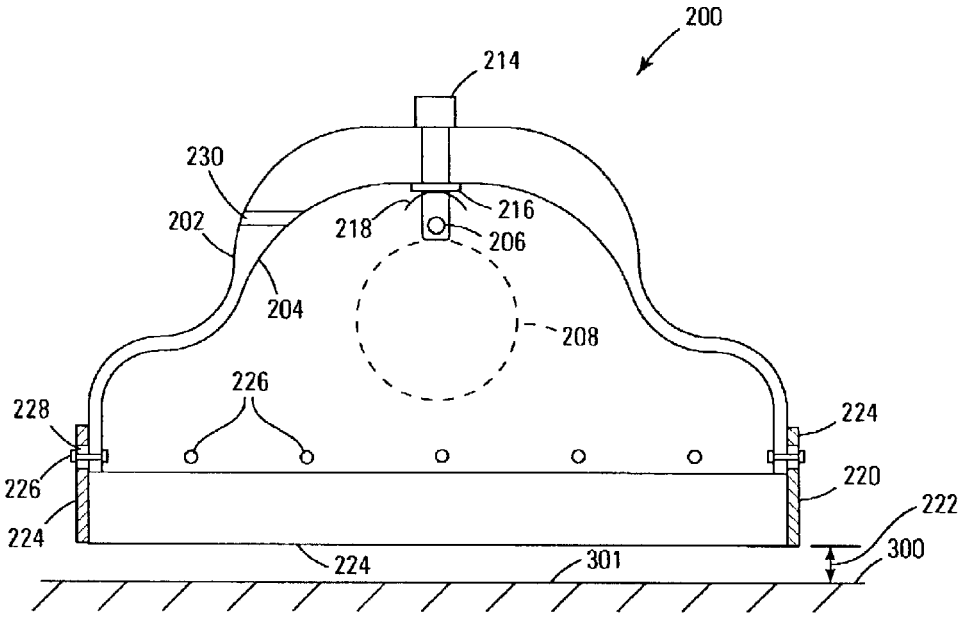
FIG. 3A is a partial section view in accordance with one embodiment of the present invention taken along line 3—3 of FIG. 1.
Figure 3B:
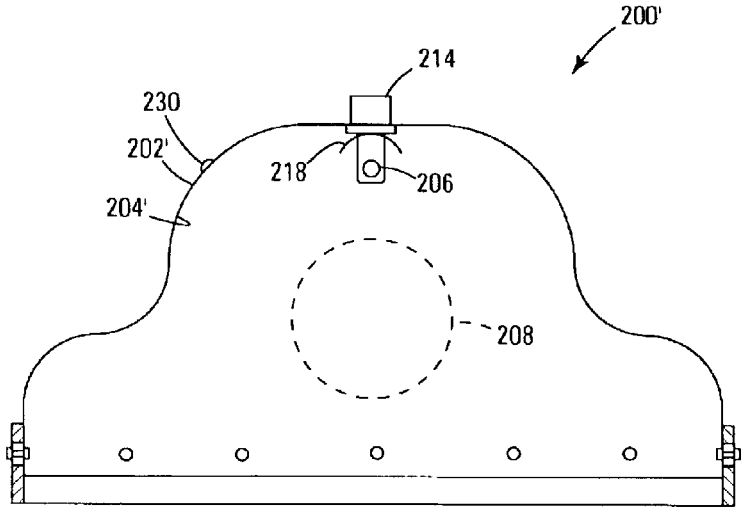
FIG. 3B is a partial section view in accordance with another embodiment of the present invention taken along line 3—3 of FIG. 1.

FIGS. 2, 3A, and 3B illustrate cross sectional views of the curing head 200 of FIG. 1. The curing head 200 may be formed by an outer skin or shell 202 (see FIG. 3A) which substantially surrounds and contains the curing head components. Preferably, the curing head 200 forms a hood that partially surrounds the UV radiation source, e.g., surrounds the top and sides, but opens toward the floor surface 300 as shown in FIG. 3A. At least one reflective interior surface 204 (e.g., a contoured aluminum sheet), may be provided to assist in directing the UV radiation generated by the UV radiation source to the floor surface 300.

While the illustrated embodiment of FIG. 3A shows the reflective inner surface 204 as contoured, most any shape, e.g., semi-cylindrical, that focuses or directs the emitted UV energy to a floor coating 301 on the floor surface 300 is within the scope of the invention.

FIG. 3B illustrates a cross-sectional view of another embodiment 200' of the curing head. In this embodiment, a reflective inner surface 204' is formed on the underside of the outer skin or shell 202'. The surface 204' may be the actual underside of the outer skin 202' or may be a foil liner attached thereto. Otherwise, the curing head 200' is substantially identical to the curing head 200 of FIG. 3A.

The UV radiation source may include one or more UV lamps 206. In a preferred embodiment, the UV radiation source includes three separate UV lamps 206 transversely spaced across the width of the curing head 200 as shown in FIG. 2. These lamps 206 are preferably medium pressure mercury flood lamps having a ballast incorporated on the lamp (self-ballasted). Alternatively, the lamps may be externally ballast driven, e.g., having ballasts located within the ballast apparatus 110 of FIG. 1. Optional cooling apparatus, e.g., fans 208, may be provided to ensure sufficient cooling of the lamps 206.

Each lamp 206 is preferably operable to simultaneously emit UV radiation at the two different wavelengths to initiate curing of the floor coating material. For example, each lamp may emit a first wavelength in the range of about 350 nm to about 380 nm and a second wavelength in the range of about 240 nm to about 270 nm. More preferably, the first wavelength is about 365 nm and the second wavelength is about 254 nm.

Ideally, each lamp 206 is selected such that the dopants therein provide energy "spikes" at the desired wavelengths, e.g., at the specific wavelengths that activate the UV reactive components in the floor coating material. That is, the lamps 206 are matched with the floor coating material in that a significant portion of the UV energy emitted by each lamp 206 occurs at the desired wavelengths, e.g., at 365 nm and 254 nm. Stated yet another way, the ultraviolet radiation emitted by each lamp 206 is greater (and preferably substantially greater) at the desired wavelengths than at other wavelengths.

FIG. 2 also illustrates brackets 215 which support each lamp 206 during operation. The brackets 215 may be attached, e.g., bolted, to a lamp support member 216 which is, in turn, secured to the curing head 200 by fasteners (not shown) or by other securing methods (e.g., adhesives). A reflector 218 (see FIG. 3A) may be included with each bracket 215 to better direct UV radiation to the floor surface 300.

The curing head 200 is preferably removably secured, e.g., bolted, to the frame 102 of the machine 100 at a working height such that a lowermost surface of the UV radiation source, e.g, a surface of the lamp 206 which is closest to the floor surface, is about 4 inches to about 7 inches, and more preferably, about 5.5 inches above the floor surface 300 (see FIG. 3A). However, the curing head 200 may be adjustable (relative to the frame 102) to provide a machine 100 having most any working height.

The curing head 200 may also be designed for easy removal from the frame 102. For example, each attaching bolt, as shown in FIG. 1, may include a hand knob 116 to facilitate removal and attachment of the curing head 200 without tools. The curing head 200 may additionally include handles 214 to assist in lifting the curing head 200 once it is separated from the machine 100. While a detachable curing head 200 is not required, removal of the curing head after use and careful packaging during shipping of the machine 100 may reduce the occurrence of broken lamps.

The electric wires that provide power to the curing head 200, e.g., to the lamps 206 and the optional fans 208, are preferably contained within one electrical cable bundle 113 (see FIG. 1) that connects to the curing head with a single quick-disconnect electrical connector 210. Thus, all electrical connections to the curing head 200 may be readily disconnected via the single connector 210 when the curing head 200 is removed from the machine 100.

On the curing head 200, separate cables 212 (see FIG. 2) may route electrical power from the electrical connector 210 to the cure head components, e.g., the lamps 206 and fans 208.

To reduce inadvertent UV illumination outside of the curing head 200, the peripheral walls 220 of the curing head preferably extend downwardly toward the floor surface 300 as generally illustrated in FIGS. 2 and 3A. The actual distance 222 between the lower edge of the walls 220 and the floor surface 300 may vary but is preferably selected to reduce the amount of UV illumination outside of the curing head 200. For example, in one embodiment, the distance 222 is about 0.5 to 1.5 inches and, more preferably, about 0.75 inches. In most circumstances, this distance 222 is sufficient to render the amount of UV illumination outside of the cure head 200 insignificant, resulting in little or no UV exposure to the operator or to bystanders. Furthermore, maintaining the distance 222 in this range may reduce inadvertent curing of the floor coating beyond the periphery of the cure head 200 as well as prevent inadvertent floor contact as the curing head 200 encounters undulations in the floor surface.

In some embodiments, the distance 222 (see FIG. 3A) may be adjustable. For example, in the curing head configuration illustrated in FIGS. 2 and 3A, each of the four peripheral walls 220 may include an adjustable skirt portion 224 which may be raised or lowered to change the distance 222. By raising the skirt portions, the area of UV illumination may be advantageously increased. For instance, by raising the skirt portion 224 on one side of the curing head 200, the machine 100 may more effectively cure the floor coating along the edge of a wall.

The actual method of securing the skirt portions 224 may vary. For example, the skirt portions may magnetically attach to the outer shell 202. In other embodiments, the skirt portions 224 may attach to the curing head 200 with fasteners 226 as shown. To provide adjustability, the fasteners may pass through slots 228 in the skirt portions 224, permitting each skirt portion 224 to be independently raised or lowered once the fasteners 226 are loosened.

Figure 4:
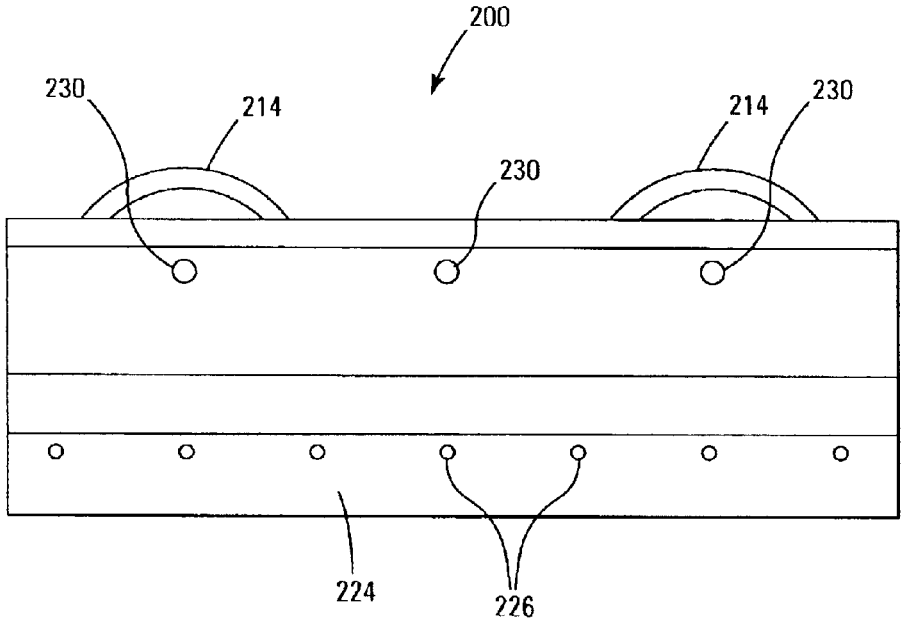
FIG. 4 is a partial front elevation view of the UV curing apparatus of FIG. 1.

Other features of the curing head 200 may be provided to improve operation of the machine 100. For example, to ensure that the lamps 206 are functional during curing, the curing head 200 may also include lamp indicators, e.g., visual lamp indicators 230, that provide verification that each lamp is operational. In one embodiment, the lamp indicators 230 include a window or light conduit (see FIGS. 3A and 4) associated with each lamp. When the lamps are powered, light from each lamp 206 is clearly visible through the respective window. When a lamp 206 is nonfunctional, light visible through the associated window is substantially reduced. Although shown on the front portion of the curing head 200 in FIG. 4, the lamp indicators 230, e.g., windows, may be located at most any location, e.g., along the top or rear portion of the curing head 200.

Other optional features are also within the scope of the invention. For example, tilt switches may be included to disable the machine 100, e.g., engage a wheel brake or disable power to the lamps 206, when the machine tilts beyond a predetermined angle. Level indicators may also be used to assist the operator in coupling the curing head 200 to the machine 100. Speed indicators, such as a visual indicator (e.g., a speedometer) or an audible indicator (e.g., a tone), may be provided to indicate when a predetermined travel speed of the machine is reached.

In one exemplary implementation of the invention, a UV curing machine 100, as described herein above and generally illustrated in the figures (see e.g., FIGS. 1, 2, 3B, and 4), was fitted with UV lamps 206 each configured to simultaneously emit UV light at wavelengths of 365 nm and 254 nm. The curing head 200 utilized three lamps 206 to provide a cure coating width (e.g., transverse cured width produced by the head 200) of about 24 inches. The lamps were positioned such that their respective lowermost portions were about 5.5 inches from the floor surface. The lamps used were produced by Philips Electronics (Netherlands) under its part number HPA-400S. These lamps were self-ballasted and, as such, did not require the separate ballast apparatus 110 of FIG. 1. The lamps 206 operated at 120 volts AC input provided by an external electrical outlet 111 (through the cord 112 of FIG. 1).

In laboratory tests, the power input to the ballast supplying one of the lamps 206 was 400 watts. Thus, the three-lamp configuration illustrated herein had a total effective power input of about 1200 watts, or about 50 watts per inch of cured coating width. It is believed that approximately 95% of the power consumed was used to produce the 365 nm wavelength and approximately 5% was used to produce the 254 nm wavelength.

Additional power may be required if the optional cooling fans are used. However, it was discovered that the three-lamp configuration illustrated and described herein did not require the optional cooling fans 208. As a result, the cooling fan openings in the curing head 200 were sealed.

The UV curing machine configured as described above cured a 24 inch wide strip of Tennant Co. ECO-UVS UV curable floor coating material (applied over a concrete floor and having a coating thickness of about 0.002–0.005 inches) at a travel speed of about 3 inches per second. The radiant output of the UV lamps was measured to be about 0.014 joules per square centimeter on the floor coating.

Still other embodiments may utilize lamps having the separate ballast 110 (see FIG. 1). Further, other embodiments may use an onboard generator set as described above instead of a remote power connection. For example, a Honda model EU1000i generator set having a one kilowatt, 120-volt AC generator powered by a gasoline engine may be used. Use of a generator set eliminates the power cord 112, thereby eliminating potential contact between the cord 112 and any uncured floor surface. That is, the use of a generator set (or a battery pack) may provide a generally self-contained, untethered machine 100. Preferably, the generator set would include a catalytic converter to reduce emissions during indoor use. Other generators or other power sources, e.g., propane, may also be used.

Experiments further indicate that travel speeds less than or in excess of 3 inches per second, e.g., up to and beyond 8 inches per second, are also potentially feasible. In fact, most any reasonable travel speed will result in at least partial curing.

Advantageously, curing apparatus and floor coating materials of the present invention may operate at relatively low power as compared to most currently known UV floor coating systems. For example, some known UV curing systems require approximately 600 watts per inch of cured coating width. Apparatus in accordance with the present invention, however, may operate with effective power consumption of no more than about 75 watts per inch of cured coating width ("cured coating width" refers to the lateral, e.g., side-to-side, effective cure width). For example, effective power consumption by the lamps 206 may be at about 25 to about 75 watts per inch of cured coating width and, more preferably, at about 40 to about 60 watts per inch of cured coating width.

Moreover, floor curing apparatus and methods in accordance with the present invention deliver sufficient UV energy to the floor coating to ensure substantial curing without producing the excessive thermal energy that may result in overcuring and even burning of the floor coating surface. In fact, beneficial characteristics of the instant invention—e.g., UV lamps that provide UV energy spikes at the specific wavelengths corresponding to the UV reactive components in the floor coating material; and lamps located sufficiently away from the floor surface—yield a floor coating system that eliminates or substantially reduces potential floor coating overcure or burn. As a result, a controllable shutter system (between the lamps and the floor), common in other UV curing devices, is not required, nor is deactivation of the lamps 206 when the machine 100 is momentarily stopped.

The complete disclosure of the patents, patent documents, and publications cited in the Background of the Invention, the Detailed Description of Exemplary Embodiments, and elsewhere herein are incorporated by reference in their entirety as if each were individually incorporated.

Exemplary embodiments of the present invention are described above. Those skilled in the art will recognize that many embodiments are possible within the scope of the invention. For instance, ride-on machines or self-propelled, walk-behind machines are also possible. Moreover, curing heads having greater (or lesser) widths are also within the scope of the invention. Other variations, modifications, and combinations of the methods and apparatus described and illustrated herein can certainly be made and still fall within the scope of the invention. Thus, the invention is limited only by the following claims, and equivalents thereto.

What is claimed is:

1. An apparatus for curing a floor coating, comprising:

a frame supported by two or more ground engaging support members; and an ultraviolet radiation source coupled to the frame, wherein the ultraviolet radiation source comprises one or more lamps where each of the one or more lamps is operable to simultaneously emit at least two different wavelengths of ultraviolet radiation, and further wherein the ultraviolet radiation source is operable to consume power of no more than about 75 watts per inch of cured coating width.

2. The apparatus of claim 1, wherein the two or more ground engaging support members comprise wheels.

3. The apparatus of claim 1, wherein the ultraviolet radiation source is located forward of the two or more ground engaging support members during operation.

4. The apparatus of claim 1, further comprising a hood partially surrounding the ultraviolet radiation source, the hood operable to direct the two different wavelengths of ultraviolet radiation to a floor surface.

5. The apparatus of claim 4, wherein the hood comprises at least one surface of reflective material.

6. The apparatus of claim 1, wherein the ultraviolet radiation source is positioned such that a lowermost surface of the ultraviolet radiation source is suspended above the floor coating at a working height of about 4 inches to about 7 inches.

7. The apparatus of claim 1, wherein the ultraviolet radiation source is operable to consume power of about 25 to about 75 watts per inch of cured coating width.

8. The apparatus of claim 7, wherein the ultraviolet radiation source is operable to consume power of about 40 to about 60 watts per inch of cured coating width.

9. The apparatus of claim 1, further comprising a visual indicator associated with the ultraviolet radiation source, the visual indicator operable to indicate whether the one or more lamps is operational.

10. The apparatus of claim 1, wherein the ultraviolet radiation emitted by the one or more lamps is greater at the at least two different wavelengths than at wavelengths other than the at least two different wavelengths.

11. The apparatus of claim 1, further comprising a cordless, onboard power source operable to power the ultraviolet radiation source.

12. The apparatus of claim 1, wherein the apparatus is operable to receive power directly from a wall outlet.

13. An apparatus for curing a floor coating, comprising:

a frame supported by two or more ground engaging support members; and an ultraviolet radiation source coupled to the frame, wherein the ultraviolet radiation source comprises one or more lamps where each of the one or more lamps is operable to simultaneously emit at least two different wavelengths of ultraviolet radiation, and further wherein a lowermost surface of the ultraviolet radiation source is suspended about 4 inches to about 7 inches above the floor coating.

14. The apparatus of claim 13, wherein the ultraviolet radiation source is operable to consume power of no more than about 75 watts per inch of cured coating width.

15. The apparatus of claim 14, wherein the ultraviolet radiation source is operable to consume power of about 25 to about 75 watts per inch of cured coating width.

16. The apparatus of claim 15, wherein the ultraviolet radiation source is operable to consume power of about 40 to about 60 watts per inch of cured coating width.

17. The apparatus of claim 13, wherein the one or more lamps comprises at least one self-ballasting lamp.

18. A machine operable for curing floor coatings applied to a floor surface, the machine comprising:

a frame supported by two or more ground engaging wheels;

a curing head coupled to the frame and located, when the machine is in an operating configuration, forward of an axis of rotation of the two or more ground engaging wheels; and an ultraviolet radiation source associated with the curing head, the ultraviolet radiation source comprising one or more lamps, wherein each of the one or more lamps is operable to simultaneously emit at least two different wavelengths of ultraviolet radiation, and further wherein the ultraviolet radiation source is operable to consume power of no more than about 75 watts per inch of cured coating width.

19. The machine of claim 18, wherein a lowermost surface of at least one of the one or more lamps is located about 4 inches to about 7 inches above the floor surface.

20. The machine of claim 19, wherein the lowermost surface of the at least one of the one or more lamps is located about 5.5 inches above the floor surface.

21. The machine of claim 18, wherein the ultraviolet radiation source is operable to consume power of about 25 to about 75 watts per inch of cured coating width.

22. The machine of claim 21, wherein the ultraviolet radiation source is operable to consume power of about 40 to about 60 watts per inch of cured coating width.

23. The machine of claim 18, wherein each of the one or more lamps is operable to simultaneously emit a first wavelength of ultraviolet radiation between about 350 nanometers (nm) and about 380 nm and a second wavelength of ultraviolet radiation between about 240 nm and about 270 nm.

24. The machine of claim 23, wherein the first wavelength of ultraviolet radiation is about 365 nm and the second wavelength of ultraviolet radiation is about 254 nm.

25. The machine of claim 18, wherein the curing head comprises a hood partially surrounding the ultraviolet radiation source, and wherein the hood opens toward the floor surface.

26. The machine of claim 25, wherein the hood comprises one or more reflective interior surfaces operable to direct the at least two different wavelengths of ultraviolet radiation toward the floor surface.

27. The machine of claim 18, wherein the curing head further comprises a cooling apparatus.

28. The machine of claim 27, wherein the cooling apparatus comprises one or more fans.

29. The machine of claim 18, wherein the curing head further comprises at least one lamp indicator operable to indicate a status of at least one of the one or more lamps.

30. The machine of claim 18, further comprising adjustable skirt portions around at least a portion of a periphery of the curing head.

31. The machine of claim 18, wherein the two or more ground engaging wheels comprise two laterally opposing, freely rotating forward wheels, and at least one swiveling rear wheel.

32. The machine of claim 18, wherein the machine is propelled by operator force.

33. An apparatus for curing a floor coating, comprising:

a frame supported by two or more ground engaging support members; and an ultraviolet radiation source coupled to the frame, wherein the ultraviolet radiation source comprises one or more lamps where each of the one or more lamps is operable to simultaneously emit at least two different wavelengths of ultraviolet radiation, wherein the ultraviolet radiation emitted by each of the one or more lamps is greater at the at least two different wavelengths than at wavelengths other than the at least two different wavelengths.

34. The apparatus of claim 33, further wherein the ultraviolet radiation source is operable to consume power of no more than about 75 watts per inch of cured coating width.

35. The apparatus of claim 33, wherein the ultraviolet radiation source is positioned such that a lowermost surface of the ultraviolet radiation source is suspended above the floor coating at a working height of about 4 inches to about 7 inches.

* * * * *